US006756744B2

(12) United States Patent
Furukawa

(10) Patent No.: US 6,756,744 B2
(45) Date of Patent: Jun. 29, 2004

(54) METHOD OF INITIATING LIGHTING OF A DISCHARGE LAMP, CIRCUIT FOR LIGHTING A DISCHARGE LAMP, LIGHT SOURCE DEVICE USING THE CIRCUIT, AND OPTICAL INSTRUMENT INCORPORATING THE LIGHT SOURCE DEVICE

(75) Inventor: Hisao Furukawa, Hyogo-ken (JP)

(73) Assignee: Phoenix Electric Co., Ltd., Himeji (JP)

( * ) Notice: Subject to any disclaimer, the term of this patent is extended or adjusted under 35 U.S.C. 154(b) by 0 days.

(21) Appl. No.: 09/984,684

(22) Filed: Oct. 31, 2001

(65) Prior Publication Data

US 2002/0101201 A1 Aug. 1, 2002

(30) Foreign Application Priority Data

Jan. 30, 2001 (JP) ..... 2001-021842

(51) Int. Cl.[7] ..... H05B 37/00
(52) U.S. Cl. ..... 315/224; 315/289; 315/209 T
(58) Field of Search ..... 315/224, 225, 315/291, 247, 276, 307, 244, 219, 289, 261, 262, 263, 264, 209 T

(56) References Cited

U.S. PATENT DOCUMENTS 4,388,559 A * 6/1983 Lefavour ..... 315/78
4,469,981 A * 9/1984 Ruff et al. ..... 315/205
4,677,343 A * 6/1987 Hick ..... 315/61
4,987,347 A * 1/1991 Leskovec et al. ..... 315/209 R
5,036,256 A 7/1991 Garrison et al. ..... 315/308
5,111,115 A * 5/1992 Ball et al. ..... 315/239

* cited by examiner

*Primary Examiner*—Wilson Lee
(74) *Attorney, Agent, or Firm*—Oblon, Spivak, McClelland, Maier & Neustadt, P.C.

(57) ABSTRACT

A method of initiating lighting of a discharge lamp is provided including applying to the discharge lamp to be lighted an initiating voltage resulting from superimposition of a step-up pulse voltage of 1,000 to 3,000 V onto a voltage of 500 to 1,500 V which is continuously applied to the discharge lamp. Also provided is a circuit for lighting a discharge lamp, including a ballast for lighting the discharge lamp, and a low-voltage igniter connected to the ballast for initiating lighting of the lamp, the low-voltage igniter comprising: a lighting diode having an input side connected to an output side of the ballast and an output side connected to the discharge lamp; and a step-up device for superimposing step-up pulses onto the output of the lighting diode via a step-up pulse supply branch line connected to the output side of the lighting diode in initiating lighting of the discharge lamp.

5 Claims, 10 Drawing Sheets

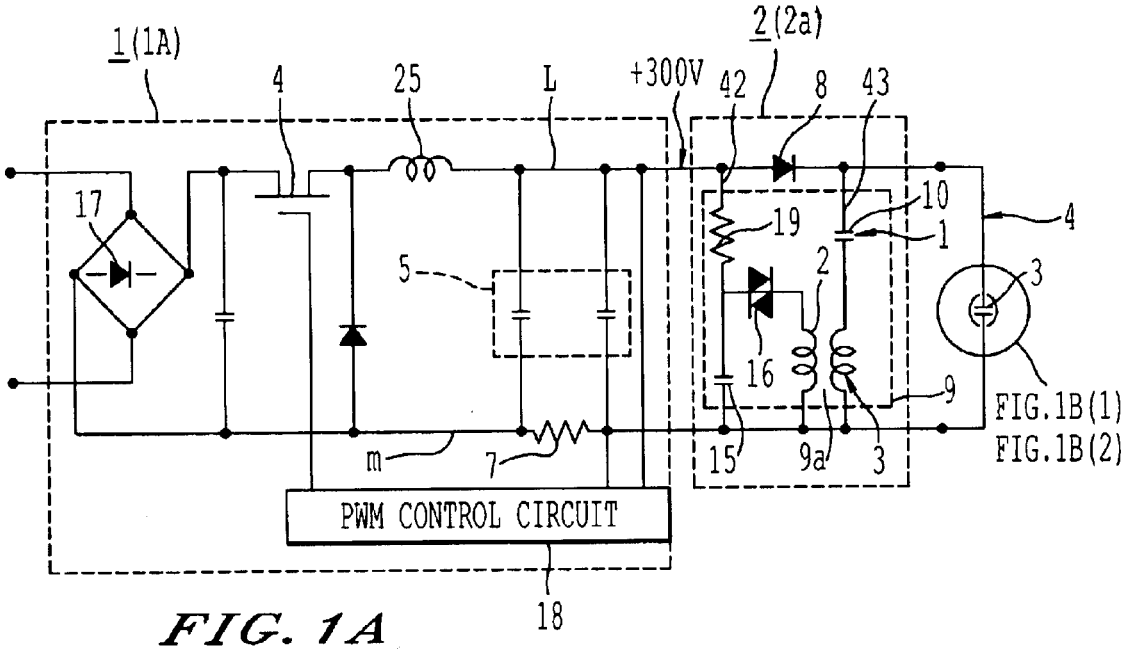
FIG. 1A
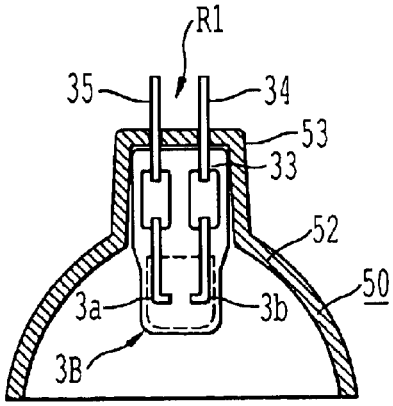
FIG. 1B(1)
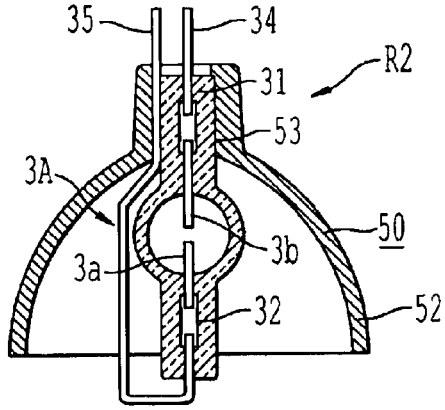
FIG. 1B(2)

METHOD OF INITIATING LIGHTING OF A DISCHARGE LAMP, CIRCUIT FOR LIGHTING A DISCHARGE LAMP, LIGHT SOURCE DEVICE USING THE CIRCUIT, AND OPTICAL INSTRUMENT INCORPORATING THE LIGHT SOURCE DEVICE

BACKGROUND OF THE INVENTION

1. Field of the Invention

The present invention relates to a method and a circuit for lighting a discharge lamp. It particularly relates to a method of initiating lighting or re-lighting of a discharge lamp and to an improvement of an igniter used to practice the method. The present invention also relates to a light source device utilizing the circuit and an optical instrument incorporating the light source device.

2. Description of the Related Art

FIG. 9A illustrates a discharge lamp lighting circuit comprising a ballast 100 for DC lighting and a prior art igniter 220 for application of high voltage pulses. Lighting of discharge lamp 300 is operated generally as follows. In initiating lighting of the discharge lamp 300 (or in initiating re-lighting of the discharge lamp 300 which has been turned off), an initiating voltage is applied across electrodes 300*a*, 300*b* of the discharge lamp 300. The initiating voltage comprises a voltage (of about 300 V) outputted from the ballast 100 and a thin mustache-like high pulse voltage of several 10 Hz (12.about.25 KV, pulse width=about 0.1 . mu.s, and pulse frequency=several 10 Hz) generated by the igniter 220 and superimposed on the output voltage of the ballast 100. FIG. 9C illustrates a waveform of such a high pulse voltage superimposed voltage applied to the discharge lamp 300 in initiating lighting.

When the high voltage pulses are repeatedly applied across the electrodes 300*a*, 300*b*, dielectric breakdown occurs between the electrodes, with the result that hot electrons are emitted from the negative electrode 300*a* to the positive electrode 300*b* to define a discharge path whereby discharge is initiated. Subsequently, when an appropriate voltage is applied to supply a current, the initial discharge state changes to a transitional discharge state referred to as glow discharge and then to a steady discharge state referred to as arc discharge. When the initial discharge state changes to glow discharge, the voltage across the electrodes 200*a*, 300*b* rapidly drops to about 15V for example. When the discharge state further changes to arc discharge, the voltage increases to for example about 80 V at which the discharge becomes steady.

As described above, a high pulse voltage of about 12 to 25 KV is applied in initiating lighting because, although the lowest voltage for initiating lighting of the discharge lamp 3 is about 500 to 700V, lighting the lamp with such a voltage disadvantageously takes a relatively long time of about 10 to 20 minutes. Particularly where the lamp is used in an optical instrument of the type which requires an initiating time of within one minute for example, a high pulse voltage of 12 KV to 25 KV is inevitably necessary.

Thus, to enhance the efficiency in initiating lighting of the lamp, a high pulse voltage needs to be applied across the electrodes 300*a*, 300*b*. This raises the following problem in lighting of prior art discharge lamp 300.

Firstly, as shown in FIG. 9B, it is required that two power supply leads 340, 350 of the lamp be spaced from each other by at least 25 mm to prevent short-circuiting during the application of high pulse voltage. Because of this requirement, usable discharge lamps are limited to double-end type lamps only. Further, when a double-end type discharge lamp 300 is used as attached to a reflector 500, one seal portion 310 of the discharge lamp 300 is fitted in a lamp-receiving portion 510 of the reflector 500, while one power supply lead 340 is drawn out of a central hole 520 formed centrally of the lamp-receiving portion 510. Therefore, to keep a necessary distance from the power supply lead 340, the other power supply lead 350 extending from the other seal portion 320 of the discharge lamp 300 need be extended out toward the back side of the reflector 500 through a through-hole 530 perforating a reflecting surface 520 of the reflector 500.

The through-hole 530 of the reflective surface 520 is formed by drilling the reflector 500 using a diamond drill for example, which may lead to an increase in cost. Further, the provision of the through-hole 530 may give rise to small cracks in the reflector. Therefore, the reflector 500 may break from the cracked portion due to the thermal cycle resulting from ON-OFF operations of the discharge lamp 300. Further, when the lamp 300 is broken, the reflector 500 may also break, scattering hot glass pieces. Further, since a high pulse voltage is applied in initiating lighting of the lamp as described above, electric parts having a high withstand voltage need to be used, which increases the cost for making the whole electric circuit.

Moreover, in initiating lighting or re-lighting of the discharge lamp 300, particularly in initiating re-lighting of the lamp immediately after having been turned off, of which the bulb temperature is high, the internal pressure of the lamp is high so that the insulation resistance between the electrodes 300*a*, 300*b* is also high. Therefore, a high voltage of at least 12 to 25 KV need be applied to the discharge lamp 300 to cause dielectric breakdown between the electrodes 300*a*, 300*b* for staring discharge. Therefore, the prior art igniter 220 uses a second step-up transformer 610 in addition to a first step-up transformer 600 in increasing the voltage to a required value. However, with this method which uses two step-up transformers 600 and 610, the voltage raising response is poor and the frequency of the high voltage pulses is limited to several 10 Hz. Therefore, there exists a limitation on an improvement in the lighting speed of the discharge lamp 300.

On the other hand, in some applications of the discharge lamp 300, the discharge lamp 300 is required to light or re-light at a very high lighting speed (e.g., in one minute when the lamp is used for an optical instrument such as a projector). To fulfill such requirement, a high initiating voltage as described above is inevitably necessary.

It has however pointed out that an application of a high pulse voltage across the electrodes 300*a*, 300*b* in initiating lighting of the lamp may cause sputtering so that electrode materials adhere to the inner surface of an arc tube 300*c*, which accelerates blackening and shortens the lifetime of the lamp.

Further, the prior art igniter 220 uses the two step-up transformers 600, 610 in two stages. Specifically, since the secondary coil of the second step-up transformer 610 is connected in series to the output side of the ballast 100, a current capacity which is equal to or more than the output of the ballast 100 is required. For this purpose, it is necessary to use a coil formed of a thick wire on the output side of the second step-up transformer 610. However, forming a coil of a thick wire increases the size of the second step-up transformer 610. Further, with such a thick wire, it is difficult to make a coil having a required number of turns for increasing the turn ratio of the transformer.

Therefore, the first step-up transformer 600 is utilized prior to the second step-up transformer 610 to increase the voltage of pulses through two steps, thereby providing pulses of a required high voltage. However, this structure requires an increased parts count and hence hinders the size reduction of the igniter 220.

In order to reduce the size of the igniter 220 including a large number of parts under such conditions, there is no way but to reduce the spacing between the parts. For this purpose, filler need be provided between adjacent parts to assure insulation therebetween, which causes an increase in weight.

It is, therefore, a first object of the present invention to greatly lower the pulse voltage applied in initiating lighting of a discharge lamp without deteriorating the lighting performance so that the lifetime of the lamp can be significantly improved and limitation on types of usable discharge lamps can be eliminated; in other words, discharge lamps of the single end type can be used.

A second object of the present invention is to develop an igniter which is capable of reducing the size, weight and price of a circuit for lighting a discharge lamp.

A third object of the present invention is to develop a discharge lamp lighting circuit which exhibits enhanced lighting performance and hence is applicable to an optical instrument which requires high lamp performance.

A further object of the present invention is to develop a light source device which utilizes the lighting circuit of the present invention and which is capable of easily accommodating or dealing with power supply leads of a lamp of the single end type or the double end type.

A still further object of the present invention is to provide an optical instrument incorporating such a light source device.

SUMMARY OF THE INVENTION

In accordance with a first aspect of the present invention, there is provided a method of initiating lighting of a discharge lamp, comprising applying to the discharge lamp to be lighted an initiating voltage resulting from superimposition of a step-up pulse voltage of 1,000 to 3,000 V onto a voltage of 500 to 1,500 V which is continuously applied to the discharge lamp. This method has following advantages.

First, the difference between the method of the present invention and the prior art method will be briefly described relative to FIG. 9C. In the prior art method, thin mustache-like pulses of a high voltage are applied to discharge lamp 300 to initiate discharge. However, since the energy of such thin mustache-like pulses is the product obtained by multiplying the pulse width by the voltage, the energy of such pulses is small. Therefore, even if such thin mustache-like high voltage pulses are applied to start emission of electrons from an electrode 300*a*, the voltage drops in a short time to stop the emission of electrons half way due to a short application time, thereby causing an "interrupted" state to result.

To avoid such an interrupted state, high voltage pulses may be continuously applied in a short time. However, when the voltage is raised by a two-stage process using two set-up transformers 600 and 610, the responsiveness is poor so that the resulting pulses are limited on several 10 Hz at most. Therefore, a high pulse voltage of 12 to 25 KV needs to be inevitably applied to cause electrons to be continuously emitted for avoiding the interrupted state.

In the method of the present invention, on the other hand, a minimum lighting voltage of 500 to 1,500 V is constantly applied across electrodes 3*a*, 3*b*, and a step-up pulse voltage of 1,000 to 3,000 V is superimposed onto the minimum lighting voltage. As a result, a voltage of 1.5 to 4.5 KV can be applied. (The applied voltage is considerably lower than that applied in the prior art method.) Once the emission of electrons from the electrode 3*a* is started by application of the step-up pulses, the emission is not interrupted even when the application of step-up pulses is stopped, because the minimum lighting voltage is constantly applied across the electrodes 3*a*, 3*b*. Therefore, lighting performance comparable to that of the prior art method can be exhibited even by the application of pulses of a considerably lower voltage than in the prior art method.

The minimum lighting voltage of 500 to 1,500 V is generated as follows. As previously described, the voltage outputted from the ballast 100 is about 300 V. On the other hand, a step-up pulse voltage of .+−. 1000 to 3000 V is generated at the secondary coil of the step-up transformer 9*a* shown in FIG. 1A. Voltage on the minus or negative side energizes a lighting diode 8 in the positive direction, making current to flow through the lighting diode 8. As a result, a step-up output capacitor 10 connected to the output side of the lighting diode is charged. The charging voltage depends on the capacity of the step-up output capacitor 10 and on how the secondary coil of the step-up transformer 9*a* is connected. If the secondary coil of the step-up transformer 9*a* is connected in parallel to the discharge lamp, the charging voltage is approximately 800 V (about 700 to 800 V). If the secondary coil of the step-up transformer 9*a* is so connected as to bridge the terminals of the lighting diode 8, the charging voltage is approximately 1,200 V (about 1000 to 1,300 V). Thus, the voltage at the connecting point between the lighting diode 8 and the step-up output capacitor 10 assumes 700 to 1,500 V, which is constantly applied to the discharge lamp 3. On the other hand, the positive voltage of 1,000 to 3,000 V is opposite in polarity the lighting diode 8. Therefore, the voltage is applied, as it is, to the output terminal of the lighting diode 8 and superimposed on the voltage of 700 to 1,500 V at the connecting point between the lighting diode 8 and the step-up output capacitor 10, thereby providing a pulse voltage of 1,500 to 4,500 V. Although the case in which a step-up output capacitor is used to generate a voltage of 200 to 1,200 V is exemplarily described heretofore, the present invention is not limited thereto, and other means having a similar function may be employed. Further, the method of initiating lighting of a lamp according to the present invention is applicable to both DC lighting and AC lighting. (It is to be noted that, for AC lighting, a DC voltage applied to initiate lighting is switched to an AC voltage in the subsequent steady lighting.)

In the above-described method of the present invention, a high pulse voltage is not applied and, hence, a high withstand voltage is not required of the electric parts. Therefore, it is possible to significantly reduce the manufacturing cost for the circuit. Further, it is also possible to prevent the occurrence of sputtering between electrodes in the initiating process, thereby avoiding blackening of the lamp and preventing the lifetime of the lamp from shortening.

Moreover, the insulation distance between respective power supply leads 34,35 of the paired electrodes 3*a*, 3*b* can be reduced. For example, even in the case where the applied voltage becomes 4,500 V at a maximum as a result of superimposition of step-up pulses, the distance between the two power supply leads 34 and 35 can be reduced to about 4.5 mm. In this way, the distance between the two power supply leads 34 and 35 can be minimized according to the present invention, and it is possible to attach the lamp to a reflector in such a manner that two power supply leads 34,35 extend parallel through the lamp-receiving portion of the reflector 50. Further, it is also possible to use a single-end type discharge lamp, unlike the prior art in which only a double-end type lamp 300 can be used as attached to a reflector 500 as shown in FIG. 9B. Further, with such a double-end type lamp 300 in the prior art, it is necessary to provide a through-hole 530 at a reflective surface 520 of the reflector 500 for dealing with a power supply lead 350 extending from a seal portion 320 extending on the open side of the reflector 500.

Preferably, the pulse voltage has a pulse width of 1 to 100 μs. In the prior art method, the high voltage pulses have a very narrow pulse width of about 0.1 μs, so that even when a high pulse voltage is applied, it immediately drops. Therefore, the emission of thermions from the negative electrode 3*a* breaks off so that transition of discharge to glow discharge and then to arc discharge does not proceed smoothly. Therefore, a very high voltage of 12 to 25 KV is required.

In the present invention, however, the pulse width of the voltage pulses is in the range of from 1 to 100 μs so that the pulse voltage continues to be applied in a time period about 10 to 1,000 times as long as the prior art method. Therefore, the emission of thermions does not break off, so that the transition from glow discharge to arc discharge can smoothly proceed even with a considerably lower pulse voltage than the high pulse voltage used in the prior art. Moreover, by lowering the initiating pulse voltage, the generation of noise is reduced so that it is possible to reduce the malfunction of an apparatus such as a projector which incorporates the circuit of the present invention.

In accordance with a second aspect of the present invention, there is provided a method of initiating lighting of a discharge lamp, comprising applying to the discharge lamp to be lighted an initiating voltage resulting from superimposition of a step-up pulse voltage of 1,000 to 3,000 V having a pulse width of from 1 to 100 μs onto a voltage of 400 to 600 V which is continuously applied to the discharge lamp.

With this method, a relatively low voltage of 400 to 600 V is continuously applied to the discharge lamp. On the other hand, a pulse voltage of 1,000 to 3,000 V having a pulse width of 1 to 100 μs is superimposed, so that emission of thermions from the cathode frequently occurs even at a low pulse voltage. Therefore, also in this case, it is possible to provide lighting performance that is higher than that provided by the prior art method.

The continuously applied voltage of 400 to 600 V is generated as follows. As previously described relative to FIG. 1A, the output voltage of the ballast 1 is about 300 V. On the other hand, a step-up pulse voltage of .+–. 1000 to 3000 V is generated on the secondary side of the step-up transformer 9*a*. The voltage on the minus or negative side energizes the lighting diode 8 in the positive direction, making current to flow through the lighting diode 8. Unlike the previously described step-up voltage output capacitor 10, a step-up output diode 11 connected to the output side of the lighting diode 8 as shown in FIGS. 4A and 5A does not have charging function. However, since the secondary coil of the step-up transformer 9*a* has a function of storing energy to some amount, a voltage lower than about 300 V is outputted to a connecting point between the lighting diode 8 and the step-up output diode 11. As a result, the voltage at the connecting point between the lighting diode 8 and the step-up diode 11 assumes appropriately 500 V (400 to 600 V), which is constantly applied to the discharge lamp 3. On the other hand, the positive voltage of 1,000 to 3,000 V is opposite in polarity to the lighting diode 8. Therefore, the voltage is applied, as it is, to the output side of the lighting diode 8 and is superimposed on the voltage of 400 to 600 V at the connecting point between the lighting diode 8 and the step-up output diode 11, thereby providing a pulse voltage of 1,300 to 3,500 V. The method of initiating lighting of the lamp according to the second aspect of the present invention is applicable to both DC lighting and AC lighting. (It is to be noted that, in AC lighting, a DC voltage applied to initiate lighting of the lamp is switched to an AC voltage in steady lighting.)

Preferably, the pulse voltage has a pulse frequency of 100 to 10,000 Hz. In the prior art method, the pulses used have a frequency of several 10 Hz at most because of the previously described reasons. Therefore, the pulse spacing is large and, hence, the interval of thermionic emission from the cathode is long so that a high voltage of 12 to 25 KV need be applied for smooth transition to arc discharge. However, in the method according to the present invention, the pulse frequency of pulses used is high with the result that the voltage drops slowly. Therefore, thermions are continuously emitted from the cathode 3*a* FIGS. 1(B)(1) and 1(B)(2), for example. Thus, transition from glow discharge to arc discharge smoothly proceeds even if a low pulse voltage is applied. Thus, it is possible to light the discharge lamp at a responsiveness which is comparable to or higher than that obtained by the conventional high pulse voltage application.

In accordance with a third aspect of the present invention, there is provided a circuit for lighting a discharge lamp, comprising a ballast for lighting the discharge lamp, and a low-voltage igniter connected to the ballast for initiating lighting of the lamp, the low-voltage igniter comprising:

- a lighting diode having an input side connected to an output side of the ballast and an output side connected to the discharge lamp; and
- a step-up device for superimposing step-up pulses onto the output of the lighting diode via a step-up pulse supply branch line connected to the output side of the lighting diode in initiating lighting of the discharge lamp.

The circuital configuration of this low-voltage igniter is applicable to both a DC ballast and an AC ballast.

Incidentally, in the following description of preferred embodiments of the present invention, designated by reference numeral 1 is a lighting ballast which is a general term conceptually including a DC ballast 1A and an AC ballast 1B. Further, a low-voltage igniter is designated by reference numeral 2 and the modifications thereof are designated by respective reference signs consisting of the numeral 2 plus an alphabetical sign.

In the aforementioned configuration of the present invention, and as illustrated in FIG. 1A, for example. a lighting diode 8 is connected to the output side of a ballast 1, and the output side of a step-up device 9 is connected to the output side of the lighting diode 8. As a result, in initiating lighting of the lamp, a pulse voltage supplied through the output side of the step-up device 9 is superimposed onto the voltage outputted from the ballast 1 for supply to the discharge lamp 3.

In other words, unlike the prior art circuit in which the entire current applied to the discharge lamp is supplied through the secondary side of the second step-up transformer 610, only the current of a high pulse voltage flows through the secondary side of the step-up device 9. That is, only a part of the current applied to the discharge lamp 3 flows through the secondary coil of the step-up device 9. Therefore, the step-up device 9 need not have a large current capacity, so that the step-up device 9 can use a coil of a thin wire. The use of a thin wire coil reduces the size and weight of the step-up device 9 while at the same time makes it possible to increase the turn ratio of the coils. Therefore, it is possible to eliminate the need for raising the voltage by a two-stage process using two large step-up transformers.

Further, since the number of parts of the low-voltage igniter 2 becomes smaller as a result of use of only a single small step-up transformer 9 and the applied voltage is considerably lower than that used in the prior art circuit, it is possible to ensure an insulation distance between adjacent ones of the parts even when the size of the circuit is reduced. Therefore, it is possible to reduce the manufacturing cost, to eliminate the need for filler which leads to further weight reduction, and to eliminate the use of an expensive high voltage cable or connector.

Preferably, the step-up device comprises a step-up transformer having a secondary side with an input terminal connected to an input side of the lighting diode (See FIGS. 3A and 5A). With this feature, the input and the output terminals on the secondary side of the step-up transformer 9*a* are so connected as to bridge opposite sides of the lighting diode 8. Therefore, even when the lighting diode 8 is damaged, secondary current does not flow toward the ballast 1, so that it is possible to prevent the ballast 1 from being damaged.

Preferably, short-circuiting means for short-circuiting the lighting diode in steady lighting is connected in parallel to the lighting diode (See FIG. 7). With this feature, the short-circuiting means is "opened" to allow the lighting diode 8 to operate in initiating lighting of the lamp. On the other hand, the short-circuiting means is "closed" to short-circuit the diode 8 when the lighting state becomes steady, so that the output from the ballast 1 is directly supplied to the discharge lamp 3. This is advantageous in avoiding power loss by the lighting diode.

In accordance with a fourth aspect of the present invention, there is provided a circuit for lighting a discharge lamp, comprising a ballast for lighting the discharge lamp, and a low-voltage igniter connected to the ballast for initiating lighting of the lamp, the low-voltage igniter comprising:

a lighting diode having an input side connected to an output side of the ballast and an output side connected to the discharge lamp;

a step-up output capacitor provided at a step-up pulse supply branch line connected to the output side of the lighting diode;

a trigger element provided at a pulse generation branch line connected to the input side of the lighting diode, and a pulse generation capacitor connected in parallel to the trigger element; and a step-up transformer having a primary side connected via the trigger element to the input side of the lighting diode and a secondary side with an output terminal connected via the step-up output capacitor to the output side of the lighting diode (See FIGS. 1A to 3A and 7).

In accordance with a fifth aspect of the present invention, there is provided a circuit for lighting a discharge lamp, comprising a ballast for lighting the discharge lamp, and a low-voltage igniter connected to the ballast for initiating lighting of the lamp, the low-voltage igniter comprising:

a lighting diode having an input side connected to an output side of the ballast and an output side connected to the discharge lamp;

a step-up output diode for output to the output side of the lighting diode, the step-up output diode being provided at a step-up pulse supply branch line connected to the output side of the lighting diode;

a trigger element provided at a pulse generation branch line connected to the input side of the lighting diode, and a pulse generation capacitor connected in parallel to the trigger element; and a step-up transformer having a primary side connected via the trigger element to the input side of the lighting diode and a secondary side with an output terminal connected via the step-up output diode to the output side of the lighting diode.

In this case, and as illustrated in FIGS. 4A and 5A, for example, the step-up output diode 11 is used instead of the step-up output capacitor 10. Therefore, the minus portion of the output from the step-up transformer 9*a* is cut off by the diode 11, so that only the plus portion of the output is supplied to the output side of the lighting diode. As a result, noises of the ballast 1 are reduced, which leads to reduced malfunction of an apparatus incorporating the lighting circuit.

In accordance with a sixth aspect of the present invention, there is provided a circuit for lighting a discharge lamp, comprising a ballast for lighting the discharge lamp, and a low-voltage igniter connected to the ballast for initiating lighting of the lamp, the ballast having output switching means for outputting non-smoothed current containing a ripple component in initiating lighting of the lamp and for outputting smoothed current in steady lighting, the igniter comprising:

a lighting diode having an input side connected to an output side of the ballast and an output side connected to the discharge lamp; and a step-up device, having a primary side using the non-smoothed current containing a ripple component outputted from the ballast and a secondary side using step-up induction current induced by the non-smoothed primary current via a step-up pulse supply branch line connected to the output side of the lighting diode as step-up pulse current, for superimposing a step-up pulse voltage of the step-up pulse current onto the output of the lighting diode in initiating lighting of the discharge lamp.

With this arrangement, the circuit configuration of the step-up device 9 can be considerably simplified because the non-smoothed current containing a ripple component outputted from the ballast in initiating lighting of the lamp is used on the primary side of the step-up device 9.

In any of the circuits described above, the ballast may be adapted either for direct current or for alternating current.

In accordance with a seventh aspect of the present invention, there is provided a light source device comprising a circuit for lighting a discharge lamp adapted for direct current or alternating current as recited above, a reflector having a concave reflecting face centrally formed with a lamp receiving portion, and a single-end type discharge lamp having a seal portion attached to the lamp-receiving portion.

In accordance with an eighth aspect of the present invention, there is provided a light source device comprising a circuit for lighting a discharge lamp adapted for direct current or alternating current as recited above, a reflector having a concave reflecting face centrally formed with a lamp receiving portion, and a double-end type discharge lamp having a first seal portion attached to the lamp receiving portion and a second seal portion with a power supply lead outwardly extending therefrom and laid along the first seal portion.

In accordance with a ninth aspect of the present invention, there is provided an optical instrument comprising a light source device as recited above and an optical system for directing light from a discharge lamp mounted to the light source device to a screen disposed in front of the light source device.

The present invention is conceived in view of the tendency of a discharge lamp to having decreasing spacing between the two electrodes. In the present invention, the characteristic that a discharge lamp can be lighted even at a relatively low discharge initiating voltage is utilized. The output current from the ballast is not supplied to the step-up transformer of the low-voltage igniter. Therefore, the coil of the step-up device can be formed of a relatively thin wire. As a result, it is possible to increase the turn ratio of the coil, so that a required step-up voltage can be obtained by a single step-up transformer.

These and other objects, features and attendant advantages of the present invention will become apparent from the reading of the following detailed description in conjunction with the attached drawings.

DETAILED DESCRIPTION OF THE PREFERRED EMBODIMENTS

Figure 1C:
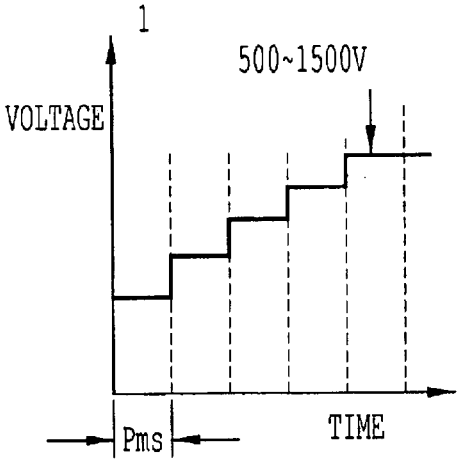
FIG. 1A is a circuit diagram of a discharge lamp lighting circuit incorporating an igniter in accordance with a first embodiment of the present invention.
FIGS. 1(B)(1) and 1(B)(2) show discharge lamps useable with the circuit illustrated in FIGS. 1C–1F illustrate voltage-time plots for various points in the circuit illustrated by FIG. 1A.

The present invention will now be described in detail with reference to the accompanying drawings. FIG. 1A illustrates a discharge lamp lighting circuit adapted for direct current which is provided with a low-voltage igniter 2 as embodiment 1 of the present invention. The low-voltage igniter 2 is connected in series to a ballast 1 for direct current. A discharge lamp 3 is connected to the low-voltage igniter 2.

The ballast 1 includes a rectifier 17, a pulse width control circuit 18 for controlling the pulse width by detecting the lighting current of the discharge lamp 3, a switching element 4 provided at a positive-side output line L of the ballast 1 for performing switching operation in accordance with control signals from the pulse width control circuit 18, a reactor 25 connected in series to the switching element 4, a smoothing capacitor 5 located between the positive-side output line L and a 0-volt line m for smoothing, in cooperation with the reactor 25, the current which has a pulse width controlled by the switching element 4, and a sensing resistor 7 provided the 0-volt line m for detecting the lamp current. With this structure, electric power necessary for steady lighting is supplied to the discharge lamp 3.

The low-voltage igniter 2 includes a lighting diode 8 connected in series to the positive-side output terminal of the ballast 1. An output from the ballast 1 is supplied via the lighting diode 8 to the discharge lamp 3, thereby performing steady lighting of the discharge lamp 3.

The positive-side output terminal of the ballast 1 is branched into a positive-side output line 41 and a branch line 42. Thus, the positive-side output terminal of the ballast 1 is connected to the input side of the diode 8 and is also connected to one terminal of the primary side of a step-up transformer 9*a* via a resistor 19 and a trigger element 16 provided at the branch line 42. The other terminal of the primary side of the step-up transformer 9*a* is connected to the 0-volt line m of the ballast 1. The resistor 19 is connected in series to one terminal of a pulse generation capacitor 15, the other terminal of which is connected to the 0-volt line m of the ballast 1. One terminal of the secondary side of the step-up transformer 9*a* is connected to the output side of the lighting diode 8 via a step-up output capacitor 10, and the other terminal is connected to the 0-volt line m of the ballast 1.

Figure 9C:
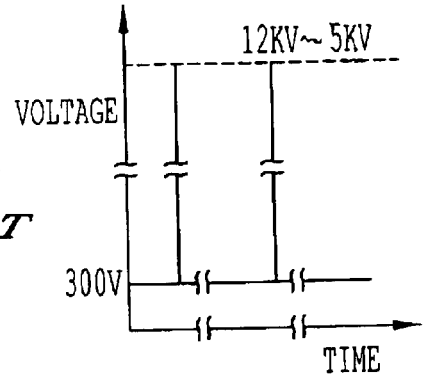
FIG. 9C PRIOR ART
FIG. 9C illustrates a voltage-time plot for a point in the circuit illustrated by FIG. 9A.
Figure 9A:
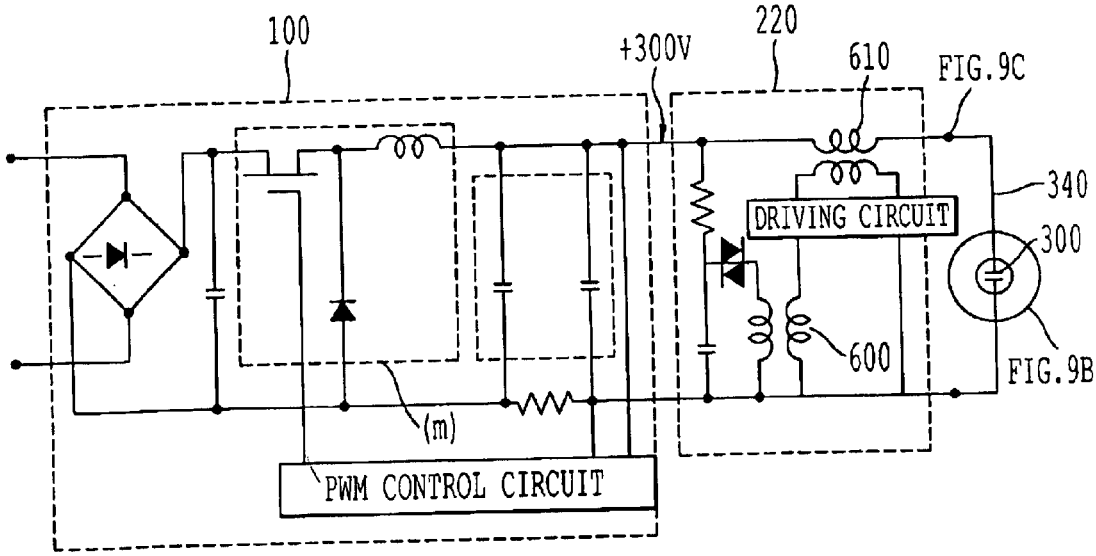
FIG. 9A PRIOR ART
FIG. 9A is a circuit diagram of a discharge lamp lighting circuit incorporating a prior art igniter.
Figure 9B:
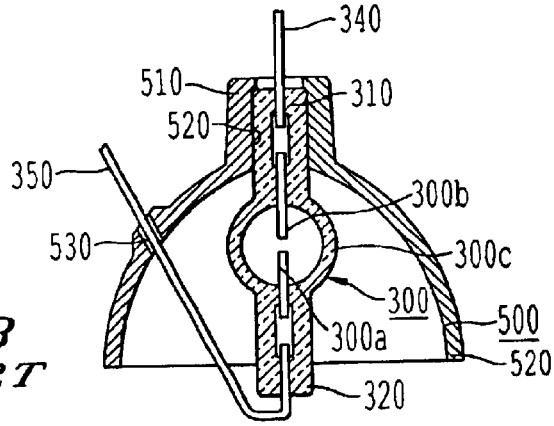
FIG. 9B PRIOR ART
FIG. 9B shows a discharge lamp useable with the circuit illustrated in FIG. 9A.

The discharge lamp 3 may be a conventionally used double-end type discharge lamp 300 attached to a reflector 500 as shown in FIG. 9B. Alternatively, use may be made of a single-end type discharge lamp 3B attached to a reflector 50, as shown in FIG. 1(B)(1), or a double-end type discharge lamp 3A having one power supply lead 35 laid as extending along a seal portion 31 fitted in a lamp receiving portion 53 of a reflector 50, as shown in FIG. 1(B)(2). In both of these cases, the power supply leads 34, 35 are located considerably closer to each other than in the case shown in FIG. 9B. Since the pulse voltage applied in initiating lighting of the lamp is low as previously described, short circuit between the power supply leads 34, 35 can be avoided if the two leads are spaced from each other by 4.5 mm at the maximum. It is to be noted that both of the single-end type discharge lamp 3B and the double-end type discharge lamp 3A are applicable not only to the circuit shown in FIG. 1A but also to the circuits shown in FIGS. 2, 3A, 4A, 5A, 6, and 7 as well as to any other circuit within the scope of the present invention. As shown in FIG. 1C, the voltage of the step-up capacitor 10 is raised stepwise because the capacity cannot be filled through a single charging so that the charging is performed several times.

Figure 8:
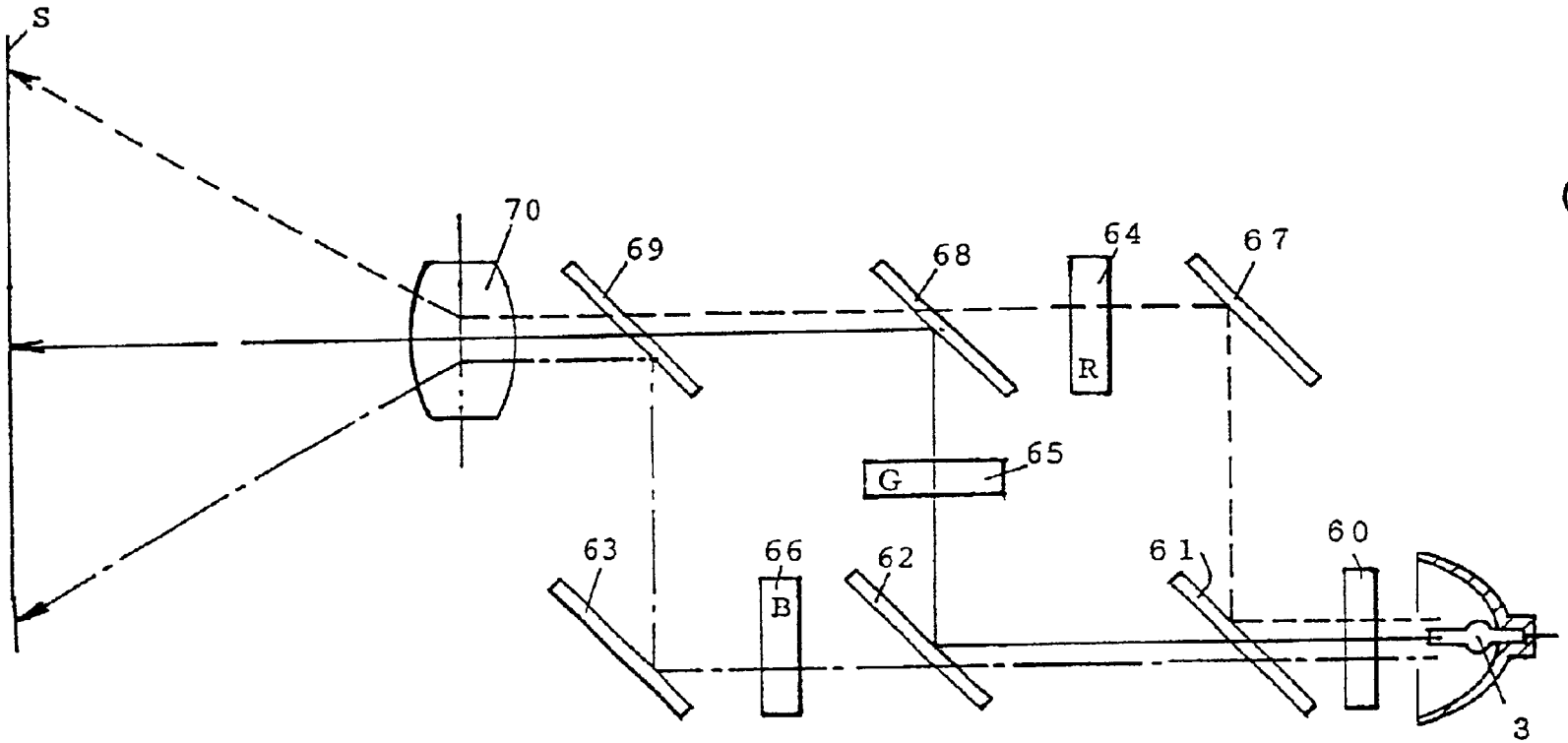
FIG. 8 is a schematic view illustrating the arrangement of an optical instrument incorporating a light source device of the present invention.

FIG. 8 schematically illustrates an optical instrument D incorporating a light-source device R (R1, R2). The optical instrument D includes, in front of the discharge lamp 3 of the right source device R, a UV-IR cut filter 60 for blocking ultraviolet and infrared rays, color separation dichroic mirrors 61 and 62 spaced back and forth, a total reflection mirror 63 disposed on the foremost side, liquid crystal panels for red, green, and blue 64, 65 and 66 arranged on respective light paths defined by the color separation dichroic mirrors 61, 62 and the total reflection mirror 63, color composition dichroic mirrors 67, 68 and a total reflection mirror 69 for projecting respective color images formed at the red, green, and blue liquid crystal panels 64, 65, 66 to form a composite color image, and a projecting lens 70 on the fore side of the color composition dichroic mirrors 67, 68 and the total reflection mirror 69.

Next, the operation of the lighting circuit shown in FIG. 1A is described. When the switch (not shown) of the optical instrument D is turned on, the optical instrument is actuated to initiate lighting of the lamp. In initiating lighting of the lamp, the rectifier 17 of the DC ballast 1A performs full-wave rectification (or half-wave rectification), and the switching element 4 performs pulse width control. The output of the switching element 4 is smoothed by the cooperation of the reactor 25 and the smoothing capacitor 5 for output from the positive side of the DC ballast 1A. The positive-side output is generally about 300 V.

The current thus outputted from the DC ballast 1A flows through the discharge lamp 3 and then through the 0-volt line m, generating a voltage at the sensing resistor 7 during the steady lighting. The pulse width control circuit 18 detects the voltage at the sensing resistor 7 to detect the lighting current flowing through the discharge lamp 3 and controls the operation of the switching element 4 so that the power supply to the discharge lamp 3 is kept constant.

Described above is the steady lighting operation of the discharge lamp 3. On the other hand, the initiation of lighting of the lamp is performed as follows. The direct current outputted from the DC ballast 1A flows as branched through the positive-side output line 41 and the branch line 42. The current flown into the branch line 42 flows through the resistor 19 to the pulse generation capacitor 15, thereby charging the capacitor 15. When the pulse generation capacitor 15 reaches a predetermined trigger voltage (of about 100 V for example) of the trigger element 16, the trigger element 16 connected in parallel to the pulse generation capacitor 15 operates to cause a pulse current to through the primary side of the step-up transformer 9*a*. In response thereto, a step-up pulse current is generated at the secondary side of the step-up transformer 9*a*.

Figure 1F:
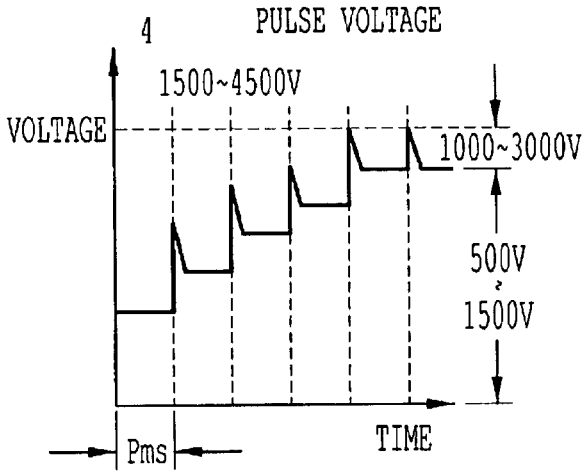
Figure 1D:
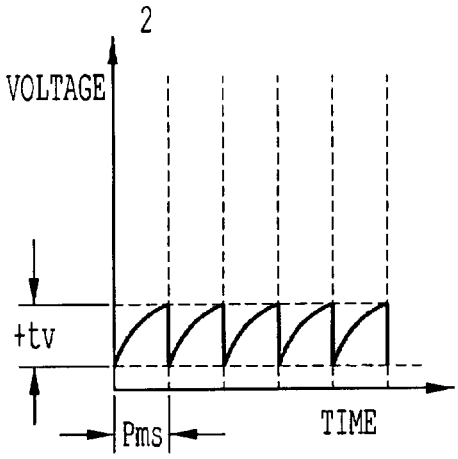
Figure 1E:
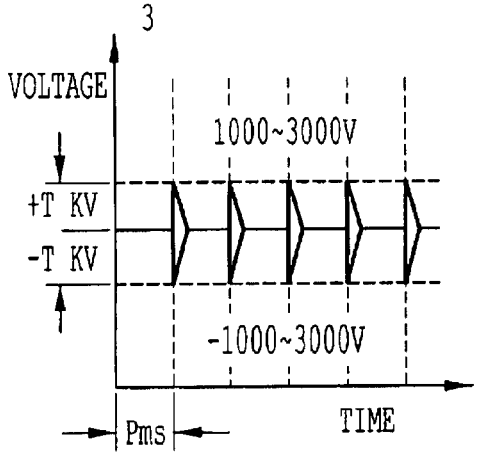

The trigger voltage is in the form of saw tooth, as shown in FIG. 1D, for example, and the pulse voltage of the step-up pulse current generated at the secondary side provides pulses which oscillate to in both the positive and negative directions, as shown in FIG. 1E, for example. The negative voltage of the pulses is applied to the lighting diode 8 in the positive direction so that current flows through the lighting diode 8, thereby charging the step-up output capacitor 10 connected to the output side of the lighting diode 8. The charging voltage depends on the capacity of the step-up output capacitor 10, but may be 700 to 1,500 V. This voltage is constantly applied to the discharge lamp 3. On the other hand, the positive voltage of 1,000 to 3,000 V of the pulses, which is opposite in polarity to the lighting diode 8, is applied, as it is, to the output side of the lighting diode 8 and superimposed onto the voltage of 700 to 1,500 at the connecting point between the lighting diode 8 and the step-up output capacitor 10, thereby providing a pulse voltage of 1,500 to 4,500 V. as shown in FIG. 1F. for example.

Since only the step-up transformer 9*a* is used and has good responsiveness, the period P (represented by ms (millisecond)) of the pulse voltage, shown as Pms in FIGS. 1C–1F, for example, is determined depending on the capacity of the pulse generation capacitor 15 or the trigger voltage of the trigger element 16. In the present invention, pulses on the secondary side are provided at 100 to 10,000 Hz. Further, the magnitude of the pulse voltage on the secondary side of the step-up transformer 9*a* is determined by the turn ratio between the primary coil and the secondary coil. In the present invention, the pulse voltage on the secondary side is adjusted to fall within the range of .+–. 1 to 3 KV.

On the other hand, the current flowing along the positive-side output line 41 flows through the lighting diode 8 in one direction, and a voltage of 500 to 1,500 V results on the output side of the lighting diode 8 and is then superimposed by the step-up pulse voltage from the step-up output capacitor 10. At this time, since the output side of the lighting diode 8 is connected to the cathode 3*a* of the discharge lamp 3, the step-up pulse current outputted from the step-up output capacitor 10 does not flow toward the DC ballast 1 but flows toward the discharge lamp 3 only. Since the step-up pulse is supplied to the output side of the lighting diode 8 due to the charging and discharging of the step-up output capacitor 10, the pulse width of the pulses assumes 1 to 100 $\mu$s, which is 10 to 1,000 times as long as the pulse width of pulses provided by the prior art.

Therefore, in initiating lighting of the discharge lamp 3, an initiating pulse voltage of 1.5 to 4.5 KV having a pulse width of 1 to 100 $\mu$s is applied at 100 to 10,00 Hz across the electrodes 3*a*, 3*b*. When the initiating pulse voltage is not applied, the minimum operating voltage of 500 to 1,500 V continues to be applied. As a result, due to the application of the step-up pulse voltage having a very short period, emission of thermions from the cathode 3*a* is not interrupted. Therefore, transition of discharge through glow discharge to arc discharge proceeds smoothly although the applied voltage is much lower than that in the prior art. Of course, the pulse width and the pulse voltage are not limited to the specific values mentioned above.

In this case, noise may be generated at peripheral circuits due to the pulse oscillation to positive and negative directions accompanied by the charging/discharging of the step-up output capacitor 10. To reduce such noise, the step-up output capacitor 10 may be replaced with a step-up output diode 11, which will be described later.

When lighting of the lamp is thus initiated, transition of discharge through glow discharge to arc discharge proceeds smoothly to realize steady lighting. When the steady lighting is thus started, the lamp voltage which has rapidly dropped during the glow discharge gradually rises to recover a predetermined value (e.g., 80 V), and this voltage is kept thereafter. At this time, the output voltage of the DC ballast 1 also drops to provide the above-described voltage so that the charging voltage for the pulse generation capacitor 15 becomes lower than the trigger voltage of the trigger element 16. Therefore, the operation of the trigger element 16 is stopped, which causes the operation of the step-up device 9 to stop. As a result, during steady lighting, the discharge lamp 3 is operated only by the lighting current supplied through the lighting diode 8.

Referring again to FIG. 8, in the steady lighting of the discharge lamp 3, light emitted from the discharge lamp 3 passes through the UV-IR cut filter 60, and then three primary colors of the light are reflected in the process of traveling through the color separation dichroic mirrors 61, 62, and the total reflection mirror 63. The respective primary colors pass through the relevant liquid crystal panels 64, 65, and 66 for red, green, and blue, thereby forming respective color images. These color images are superimposed into one composite color image at the dichroic mirror 68 and the total reflection mirror 69, which in turn is projected through the projecting lens 70 to the screen S located in front thereof.

In the foregoing optical instrument, use of a single-end type discharge lamp 3 for the light source makes it possible to reduce the size of the light source. Further, by utilizing the foregoing simplified lighting circuit of the present invention, it is possible to reduce the size of the light source device itself, as well as to reduce the cost for making the light source device because there is no need to use expensive electric parts having high withstand voltage.

Figure 2:
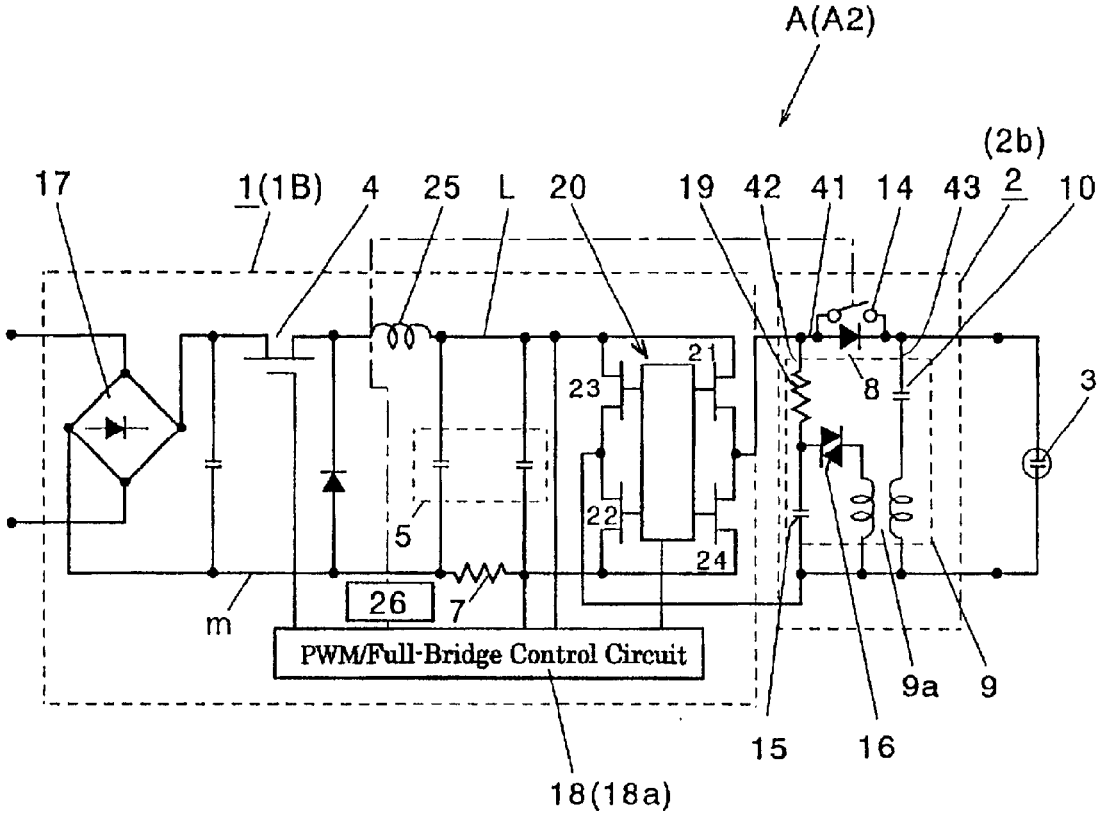
FIG. 2 is a circuit diagram of a discharge lamp lighting circuit incorporating an igniter in accordance with a second embodiment of the present invention.

Referring next to FIG. 2, a discharge lamp lighting circuit in accordance with a second embodiment of the present invention will be described. For facilitating the description, the elements which are identical to those of the first embodiment are designated by the same reference signs as those used in the first embodiment and the description thereof is omitted. This is true throughout the description of the present invention.

The FIG. 2 lighting circuit, which is a circuit for alternating current, includes a full-bridge 20 comprising FETs 21, 22, 23 and 24 combined like a bridge as output means, and switching means 14 connected in parallel to the lighting diode 8. The switching means 14 opens/closes under the control of a switching means control circuit 26. The switching means generally comprises a relay.

In initiating lighting of the discharge lamp 3, a diagonally arranged pair of FETs 21, 22 are turned on whereas another diagonal pair of FETs 23, 24 are turned off. By so doing, the switching means 14 is in an off state. As a result, a part of direct current smoothed by the smoothing capacitor 5 flows through the on-state FET 21 and then the lighting diode 8. The remaining part of the current flows through the branch line 42 to operate the step-up device 9. Thus, lighting of the discharge lamp 3 is initiated, as previously described.

When transition from glow discharge to arc discharge takes place to attain steady lighting by completing initiation of lighting of the lamp 3, the step-up device 9 stops its operation in response to a voltage drop of the lamp 3. This is detected by the sensing resistor 7, and the switching means control circuit 26 operates to short-circuit the lighting diode 8. Subsequently, the pulse width control full-bridge circuit 18*a* operates to turn on the switching means 14 connected in parallel to the lighting diode 8, while at the same time alternately turning on the pair of FETs 21, 22 and the pair of FETs 23, 24. Thus, alternating current flows through the discharge lamp 3.

Specifically, when the FETs 21, 22 are on whereas the FETs 23, 24 are off, current flows through the FET 21, switching means 14, the discharge lamp 3, and the FET 22 in the mentioned order. Conversely, when the FETs 21, 22 are off whereas the FETs 23, 24 are on, current flows through the FET 23, the discharge lamp 3, the switching means 14, the FET 24 in the mentioned order. Thus, the lamp is operated by alternating current. The cycle of alternating current is controlled by the pulse width control full-bridge circuit 18*a*. It is to be noted that the full-bridge 20 shown in FIG. 2 is applicable to any AC lighting circuit which embodies the present invention.

Figure 3A:
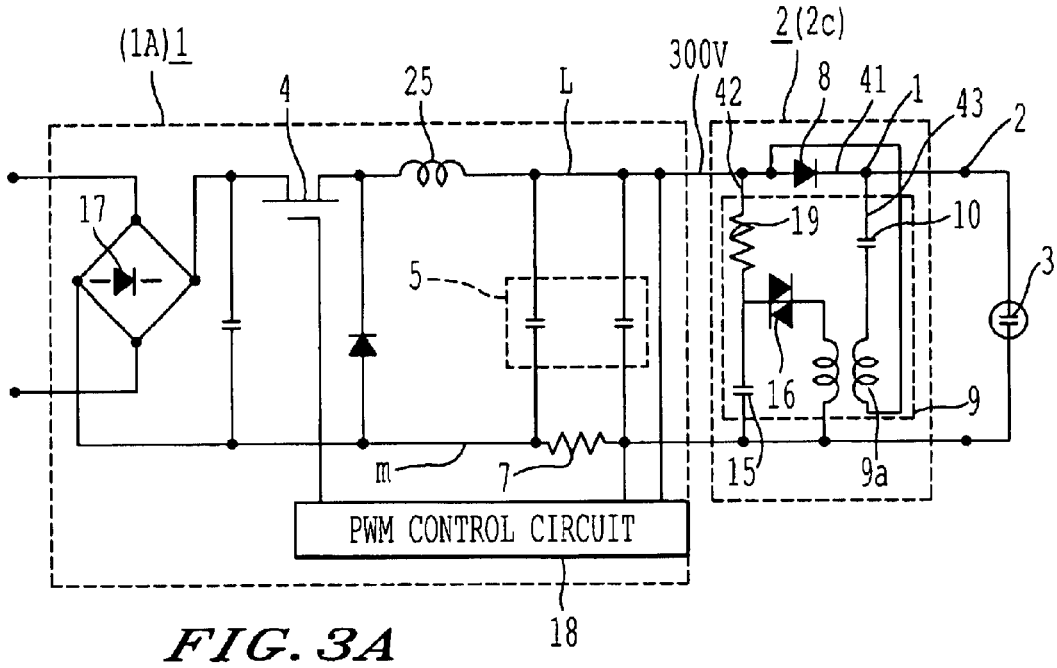
FIG. 3A is a circuit diagram of a discharge lamp lighting circuit incorporating an igniter in accordance with a third embodiment of the present invention.
Figure 3B:
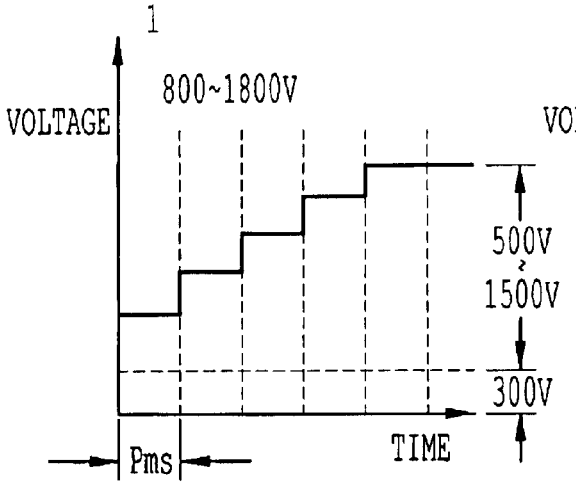
FIGS. 3B and 3C illustrate voltage-time plots for various points in the circuit illustrated by FIG. 3A.
Figure 3C:
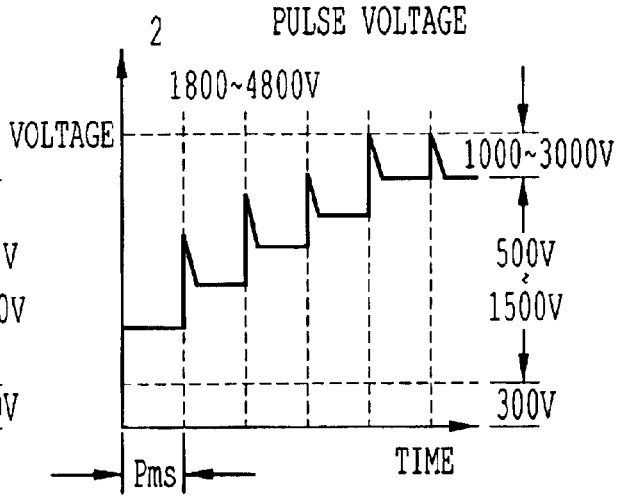

Shown in FIG. 3A is a circuit in accordance with a third embodiment of the present invention. The FIG. 3A circuit differs from the FIG. 1A circuit of the first embodiment in that the input terminal on the secondary side of the step-up transformer 9*a* is connected to the input side of the lighting diode 8. That is, the input and the output terminals on the secondary side of the step-up transformer 9*a* are connected to the opposite sides of the lighting diode 8 like a bridge. With this structure, even when the lighting diode 8 is damaged, the input and the output terminals on the secondary side of the step-up transformer 9*a* are equal in potential. Therefore, secondary current does not flow toward the ballast 1, so that the ballast 1 is prevented from being damaged. It is to be noted that the arrangement of connecting the input terminal on the secondary side of the step-up transformer 9*a* to the input side of the lighting diode 8 may be employed also in other embodiments of the present invention. It is also to be noted that the voltage steps of FIG. 3B are similar to those of FIG. 1C, while the pulse voltages illustrated by FIG. 3C and those illustrated by FIG. 1F are also similar.

Figure 4A:
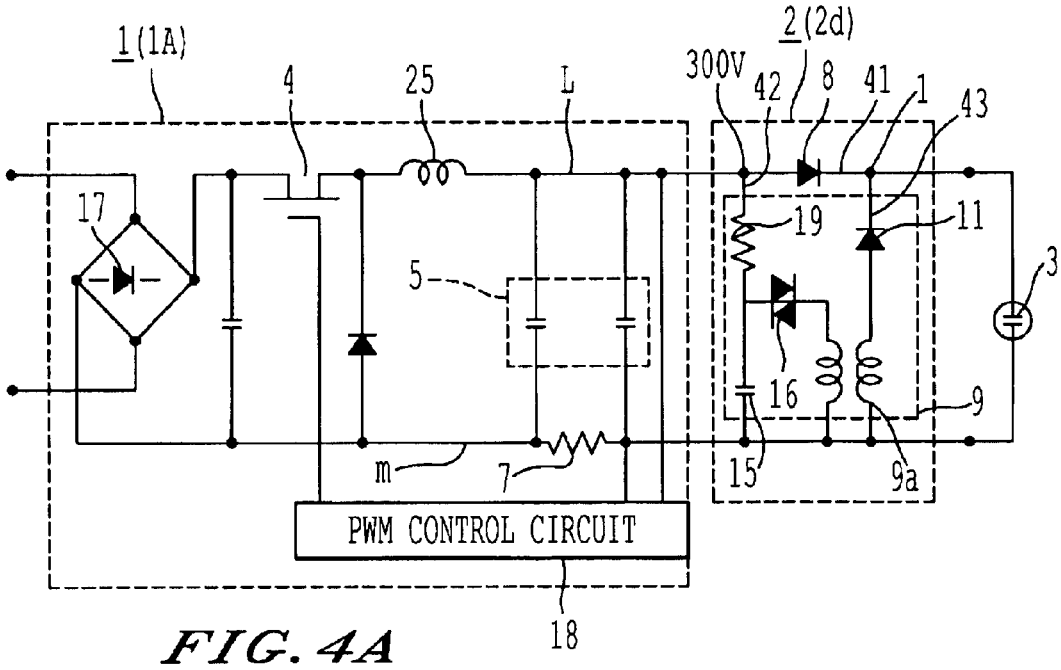
FIG. 4A is a circuit diagram of a discharge lamp lighting circuit incorporating an igniter in accordance with a fourth embodiment of the present invention.
Figure 4B:
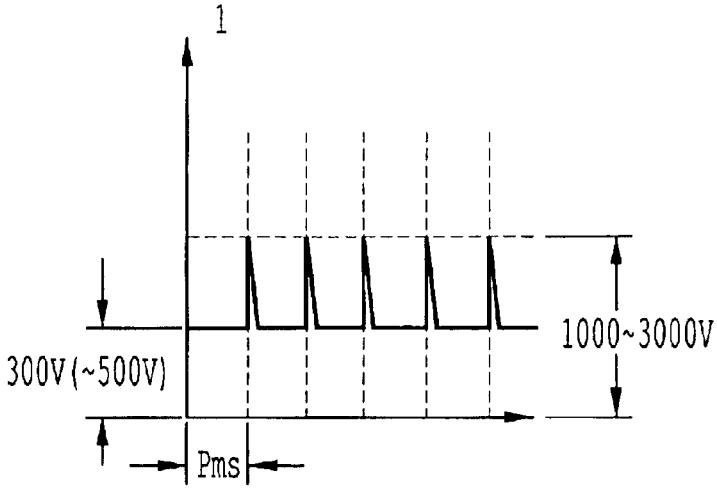
FIG. 4B illustrates a voltage-time plot a point in the circuit illustrated by FIG. 4A.

FIG. 4A illustrates a circuit in accordance with a fourth embodiment of the present invention. In contrast to the first embodiment wherein the secondary side of the step-up transformer 9*a* is connected to the positive-side output line 41 via the step-up output capacitor 10, the FIG. 4A circuit of this embodiment is characterized that the secondary side of the step-up transformer 9*a* is connected to the positive-side output line 41 via the step-up output diode 11. In the circuit of the first embodiment, when the step-up pulses containing mustache-like plus and minus components (illustrated relative to FIG. 1E) generated on the secondary side of the step-up transformer 9*a* are supplied through the step-up output capacitor 10 to the positive-side output line 41, both the plus and minus components contained in the step-up pulses are superimpose'd onto the output of the ballast. This may cause generation of noise, which may result in malfunction of the instrument incorporating the circuit. However, in the circuit of this embodiment, only the plus components of the pulses are supplied through the step-up output diode 11, as illustrated relative to FIG. 4B, so that generation of noise is considerably reduced.

Specifically, as described before, a pulse voltage of ±1,000 to 3,000 V is generated on the secondary side of the step-up transformer 9*a*. The minus component of the pulse voltage energizes the lighting diode 8 in the positive (plus) direction, making current to flow through the lighting diode 8. However, unlike the step-up output capacitor 10 used in the first embodiment, the step-up output diode 11 connected to the output side of the lighting diode 8 does not have charging function. (Since the secondary side of the step-up transformer 9*a* has the function of storing energy to some extent, a voltage of not greater than 300 V is outputted to the connecting point between the lighting diode 8 and the step-up output diode 11.) As a result, the voltage at the connecting point between the lighting diode 8 and the step-up output diode 11 assumes 400 to 600 V, which is constantly applied to the discharge lamp 3.

On the other hand, since the plus component of the pulse voltage of 1,000 to 3,000 V is opposite in polarity to the lighting diode 8, the voltage is applied, as it is, to the output side of the lighting diode 8 and superimposed onto the voltage of 400 to 600 V at the connecting point between the lighting diode 8 and the step-up output capacitor 10, thereby providing a pulse voltage of 1,300 to 3,500 V.

Figure 5A:
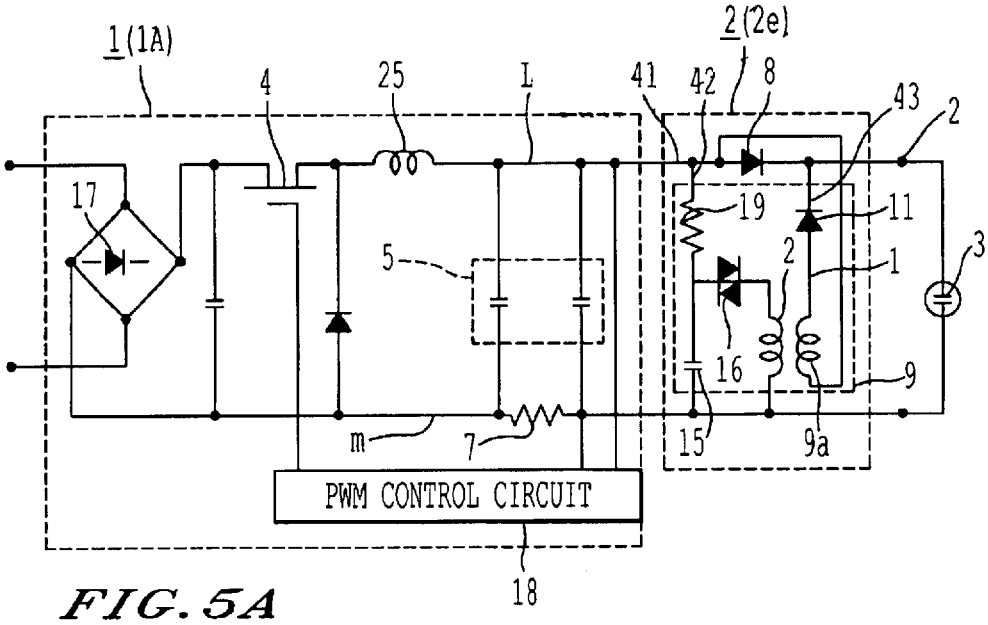
FIG. 5A is a circuit diagram of a discharge lamp lighting circuit incorporating an igniter in accordance with a fifth embodiment of the present invention.
Figure 5B:
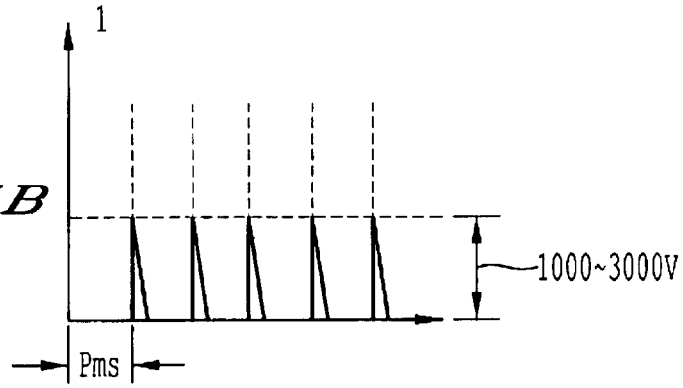
FIGS. 5B and 5C illustrate voltage-time plots for various points in the circuit illustrated by FIG. 5A.
Figure 5C:
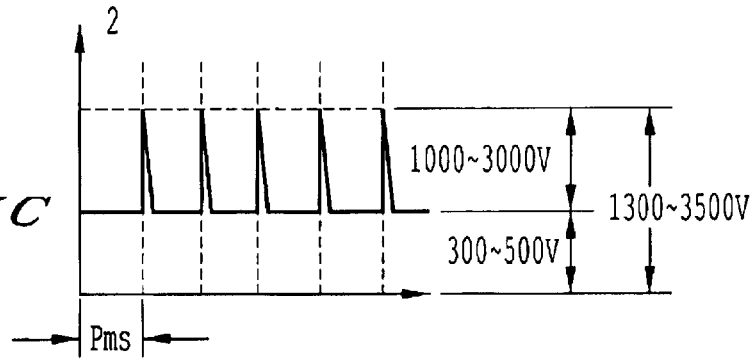

Shown in FIG. 5A is a circuit in accordance with a fifth embodiment of the present invention. The FIG. 5A circuit in this embodiment is similar in configuration to that of the FIG. 3A circuit of the third embodiment, with the difference residing in that step-up output diode 11 is used instead of the step-up output capacitor 10. With this structure, it is possible to obtain the advantages of both the FIG. 3A and FIG. 4A circuits, such as improvements in the anti-breakage and less-noise properties of the lighting diode 8. Compare FIG. 5B to FIG. 1E and FIG. 5C to FIGS. 3C and 4B.

Figure 6:
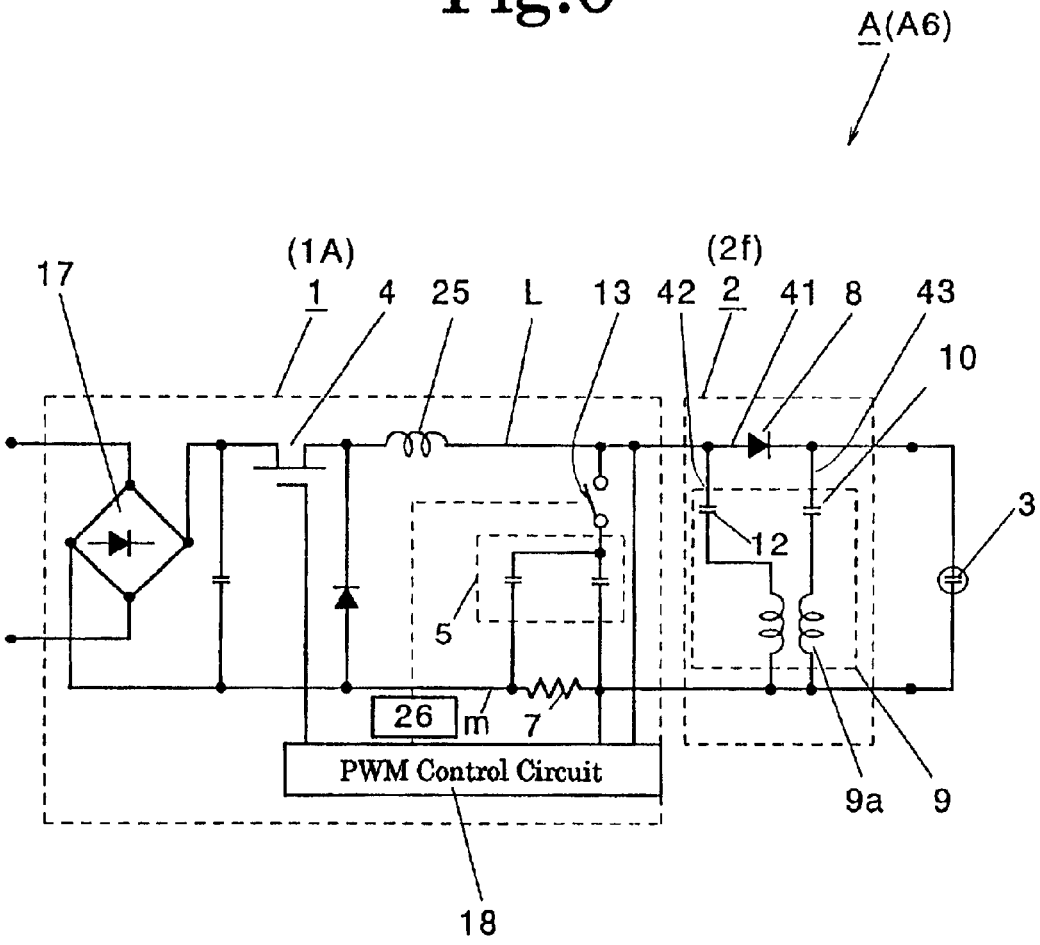
FIG. 6 is a circuit diagram of a discharge lamp lighting circuit incorporating an igniter in accordance with a sixth embodiment of the present invention.

FIG. 6 illustrates a circuit in accordance a sixth embodiment of the present invention. In this embodiment, the ripple component of output of the ballast 1 is utilized instead of using the trigger element 16. Specifically, the primary side of the step-up transformer 9*a* is connected to the output side of the ballast 1 only through the capacitor 12, whereas the secondary side of the step-up transformer 9*a* is inserted between the output side of the lighting diode 8 and the 0-volt line m of the ballast 1. The step-up pulses of the step-up transformer 9*a* are superimposed, via the step-up output capacitor 10 (which may be replaced with the step-up output diode 11), onto the output of the ballast 10 for supply to the discharge lamp 3. Between the smoothing capacitor 5 and the output side of the ballast 1 is provided output switching means 13 such as a relay, which is controlled by a switching means control circuit 26. With this structure, the ballast 1 operates with the smoothing capacitor 5 separated therefrom by the operation of the output switching means 13 until lighting of the discharge lamp 3 is achieved and the ripple component is utilized during this period to generate step-up pulses.

That is, in initiating lighting of the lamp, the output switching means 13 is opened so as not to perform smoothing, while the ripple component of the ballast output is utilized to charge/discharge the capacitor 12. Thus, pulse current is supplied to the primary side of the step-up transformer 9, causing step-up pulse current to generate on the secondary side of the step-up transformer 9. As previously described, switching from the lamp initiating operation to the steady lighting operation is performed by means of the sensing resistor 7. Specifically, when the shift to the steady lighting is detected, the output switching means 13 is closed so that the output from the ballast 1 is smoothed to be outputted as smoothed direct current. As a result, the charging/discharging of the capacitor 12 does not occur so that the step-up transformer 9 stops its operation. Since the smoothing capacitor 5 is turned off by the switching means 13 in initiating the lighting, responsiveness of the ballast 1 is enhanced, and interruption of arc in initiating the lighting is reduced. Other advantages of this embodiment are similar to those of the first embodiment.

Figure 7:
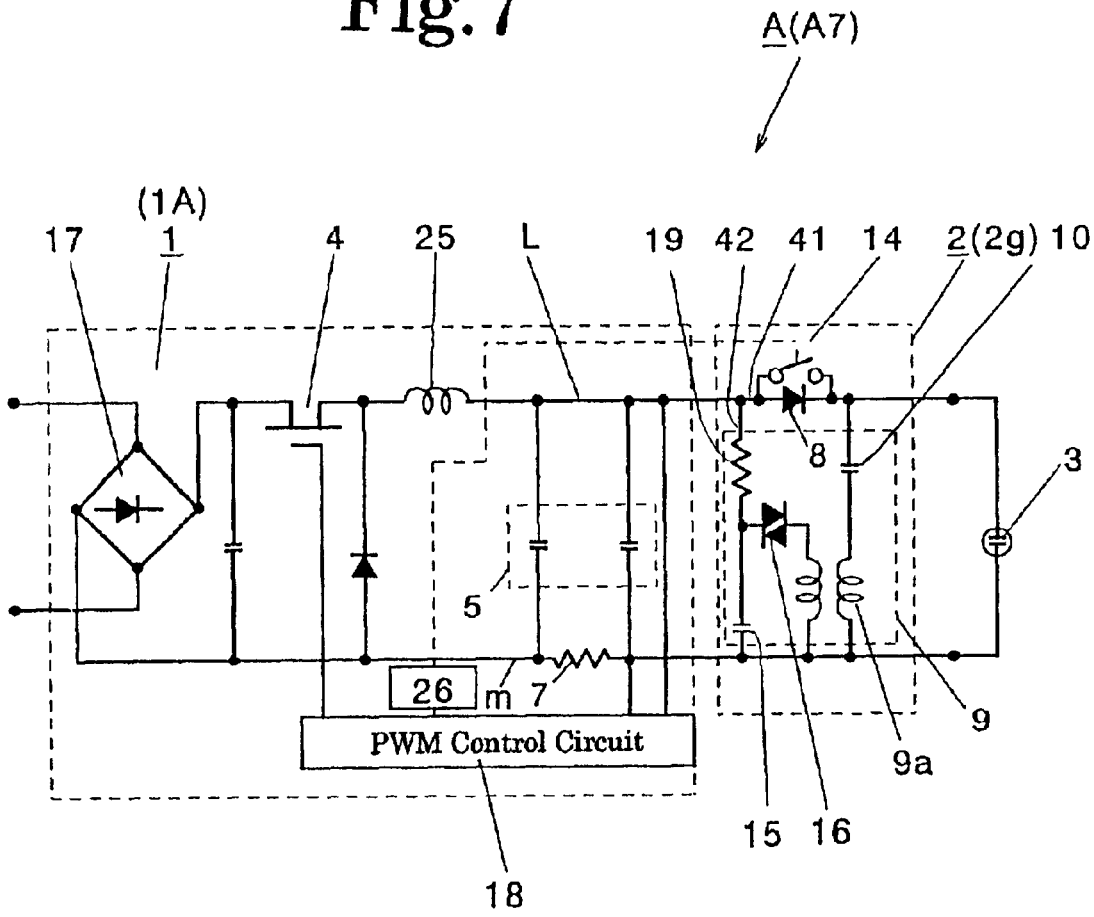
FIG. 7 is a circuit diagram of a discharge lamp lighting circuit incorporating an igniter in accordance with a seventh embodiment of the present invention.

Shown in FIG. 7 is a circuit in accordance with a seventh embodiment of the present invention. In this embodiment, short-circuit means 14 is connected in parallel to the lighting diode 8 connected in series to the output side of the ballast 1. The short-circuit means 14 is switched on/off by the switching means control circuit 26. In steady lighting, the lighting diode 8 is short-circuited by the short-circuit means 14 because of the following reason.

When the output of the ballast 1 is relatively large and the lighting diode 8 is connected in series to the output side of the ballast 1, power loss may occur in steady lighting. In this embodiment, therefore, after the discharge lamp 3 is lighted, the lighting diode 8 for operating the discharge lamp is short-circuited by the switching means 14 such as a relay. Specifically, the switching means 14 connected to the opposite sides of the diode 8 is opened in initiating lighting of the lamp to operate the lighting diode 8 and is closed in steady lighting to short-circuit the diode 8 to prevent power loss caused by the diode 8.

As described above, according to the present invention, it is possible to considerably reduce the pulse voltage to be applied in initiating lighting of the lamp without deteriorating the lighting performance. Therefore, the lifetime of the lamp can be prolonged and limitation on types of usable discharge lamps can be eliminated. Further, the weight and the price of the lighting circuit can be reduced. Moreover, since it is possible to apply pulses having an increased pulse width and continuously apply lighting pulses, higher lighting performance can be obtained even at a low voltage application, so that the lamp of the present invention can be used in an optical instrument such as a projector which requires high lamp performance. Further, by utilizing a lighting circuit enabling such a lighting method, a light source device is provided which is capable of easily accommodating or dealing with power supply leads of a single-end type lamp or a double-end type lamp, and an optical instrument utilizing such a light source device.

While only presently preferred embodiments of the present invention have been described in detail, as will be apparent for those skilled in the art, certain changes and modifications can be made in embodiments without departing from the spirit and scope of the present invention as defined by the following claims.

What is claimed is:

1. A circuit for lighting a discharge lamp, comprising a ballast for lighting the discharge lamp, and a low-voltage igniter connected to the ballast for initiating lighting of the lamp, the low-voltage igniter comprising:

a lighting diode having an input side connected to an output side of the ballast and an output side connected to the discharge lamp;

a step-up output capacitor provided at a step-up pulse supply branch line connected to the output side of the lighting diode;

a trigger element provided at a pulse generation branch line connected to the input side of the lighting diode, and a pulse generation capacitor connected in parallel to the trigger element;

and a step-up transformer having a primary side connected via the trigger element to the input side of the lighting diode and a secondary side with an output terminal connected via the step-up output capacitor to the output side of the lighting diode.

2. A circuit for lighting a discharge lamp, comprising a ballast for lighting the discharge lamp, and a low-voltage igniter connected to the ballast for initiating lighting of the lamp, the ballast having output switching means for outputting non-smoothed current containing a ripple component in initiating lighting of the lamp and for outputting smoothed current in steady lighting, the igniter comprising:

a lighting diode having an input side connected to an output side of the ballast and an output side connected to the discharge lamp; and a step-up device, having a primary side using the non-smoothed current containing a ripple component outputted from the ballast and a secondary side using step-up induction current induced by the non-smoothed primary current via a step-up pulse supply branch line connected to the output side of the lighting diode as step-up pulse current, for superimposing a step-up pulse voltage of the step-up pulse current onto the output of the lighting diode in initiating lighting of the discharge lamp.

3. The circuit for lighting a discharge lamp according to any one of claims 1 and 2, wherein the ballast is adapted for direct current.

4. The circuit for lighting a discharge lamp according to any one of claims 1 and 2, wherein the ballast is adapted for alternating current.

5. The circuit for lighting a discharge lamp according to claim 1, further comprising short-circuiting means connected in parallel to the lighting diode for short-circuiting the lighting diode after the discharge lamp is lit.

* * * * *